US011806727B2

(12) United States Patent
Cho et al.

(10) Patent No.: US 11,806,727 B2
(45) Date of Patent: Nov. 7, 2023

(54) WINDOW-TYPE DUST COLLECTING APPARATUS ON BASIS OF ARTIFICIAL INTELLIGENCE

(71) Applicant: LG ELECTRONICS INC., Seoul (KR)

(72) Inventors: Tae Hoon Cho, Seoul (KR); Sang Hyuck Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 334 days.

(21) Appl. No.: 17/041,568

(22) PCT Filed: Mar. 19, 2019

(86) PCT No.: PCT/KR2019/003185
§ 371 (c)(1),
(2) Date: Sep. 25, 2020

(87) PCT Pub. No.: WO2019/190111
PCT Pub. Date: Oct. 3, 2019

(65) Prior Publication Data

US 2021/0008570 A1 Jan. 14, 2021

(30) Foreign Application Priority Data

Mar. 26, 2018 (KR) ..... 10-2018-0034512

(51) Int. Cl.
*B03C 3/68* (2006.01)
*B03C 3/47* (2006.01)
(Continued)

(52) U.S. Cl.
CPC ..... *B03C 3/68* (2013.01); *B03C 3/47* (2013.01); *B03C 3/82* (2013.01); *B03C 3/78* (2013.01)

(58) Field of Classification Search
CPC .... B03C 3/08; B03C 3/68; B03C 3/47; B03C 3/10; B03C 3/09; B03C 3/82; B03C 3/78;
(Continued)

(56) References Cited

U.S. PATENT DOCUMENTS 3,735,560 A * 5/1973 Wellman ..... B03C 3/38 96/62
7,959,718 B2 * 6/2011 Takayanagi ..... B03C 3/64 96/99
(Continued)

FOREIGN PATENT DOCUMENTS

AT 509834 A2 * 11/2011 ..... F24F 13/18
CN 2192387 1/1995
(Continued)

OTHER PUBLICATIONS

International Search Report dated Jul. 11, 2019 issued in Application No. PCT/KR2019/003185.

*Primary Examiner* — Frank M Lawrence, Jr.
*Assistant Examiner* — Sonji Turner
(74) *Attorney, Agent, or Firm* — KED & Associates LLP

(57) ABSTRACT

The present invention relates to a window-type dust collecting apparatus for effectively shielding inflow of fine dust according to external environmental factors on the basis of artificial intelligence. The window-type dust collecting apparatus according to the present invention adjusts the intensity of electric power applied to a dust collector according to the wind speed or the fine dust concentration measured by a sensor so as to optimize the electric power required for shielding the fine dust.

7 Claims, 17 Drawing Sheets

(51) Int. Cl.
*B03C 3/82* (2006.01)
*B03C 3/78* (2006.01)

(58) Field of Classification Search
CPC ..... B03C 2201/24; B03C 3/40; B03C 3/66; B03C 3/41; B03C 3/155; B03C 3/74; B03C 3/51; B03C 3/36; B03C 3/011; B03C 3/763; B03C 3/88; F24F 8/10; F24F 2221/17; F24F 2221/16; F24F 2221/14; F24F 2221/20; F24F 13/32; F24F 2013/221; F24F 13/22; F24F 13/224; F24F 2013/225; F24F 13/222; F24F 13/08; F24F 11/58; F24F 11/57; F24F 11/56; F24F 11/54; F24F 11/50; F24F 1/0358; F24F 1/0314; F24F 1/031; F24F 1/03; F24F 1/0083; F24F 1/0076; F24F 1/0057; F24F 2005/0078; F24F 2005/0082; F24F 5/0075; F24F 2007/004; F24F 7/00; F24F 8/192; F24F 8/194; F24F 2140/00; F24F 2140/60; F24F 2203/00; F24F 2203/12
See application file for complete search history.

(56) References Cited

U.S. PATENT DOCUMENTS

| | | | | |
|---|---|---|---|---|
| 10,357,781 | B2 * | 7/2019 | Luo | B03C 3/41 |
| 2011/0219954 | A1 * | 9/2011 | McKinney | B03C 3/025 96/55 |
| 2014/0345463 | A1 * | 11/2014 | Urata | F24F 8/192 96/21 |
| 2017/0120182 | A1 * | 5/2017 | Kim | F24F 11/52 |
| 2017/0241656 | A1 * | 8/2017 | Fox | F24F 8/10 |

FOREIGN PATENT DOCUMENTS

| | | | | |
|---|---|---|---|---|
| CN | 2011-65844 | | 12/2008 | |
| GB | 2424059 | A * | 9/2006 | E06B 7/10 |
| JP | 08-034229 | | 2/1996 | |
| JP | 2000-061351 | | 2/2000 | |
| JP | 2016087598 | A * | 5/2016 | |
| JP | 2017-528311 | | 9/2017 | |
| JP | 2017-533078 | | 11/2017 | |
| KR | 10-0281769 | | 3/2001 | |
| KR | 20140112341 | A * | 9/2014 | |
| KR | 20160119626 | A * | 10/2016 | |
| KR | 10-2017-0017167 | | 2/2017 | |
| KR | 10-1757187 | | 7/2017 | |
| KR | 10-2017-0088702 | | 8/2017 | |
| KR | 10-2017-0094877 | | 8/2017 | |
| KR | 10-1792228 | | 10/2017 | |
| WO | WO-2012069963 | A1 * | 5/2012 | G01N 15/0656 |

* cited by examiner

WINDOW-TYPE DUST COLLECTING APPARATUS ON BASIS OF ARTIFICIAL INTELLIGENCE

CROSS-REFERENCE TO RELATED PATENT APPLICATIONS

This application is a U.S. National Stage Application under 35 U.S.C. § 371 of PCT Application No. PCT/KR2019/003185, filed Mar. 19, 2019, which claims priority to Korean Patent Application No. 10-2018-0034512, filed Mar. 26, 2018, whose entire disclosures are hereby incorporated by reference.

TECHNICAL FIELD

The present disclosure relates to a window-type dust collecting apparatus to effectively block inflow of fine dust according to external environmental factors.

BACKGROUND ART

A window frame is disposed at one side of a residential space to ventilate indoor air and a window is slidably disposed in the window frame to ventilate the indoor air in the residential space. When the window is opened, various external pests and foreign substances may flow into the indoor space. In related art, to prevent the pests and dust, an window screen has been used to pass air incoming from outside and block an entry of the pests. However, the window screen has a disadvantage in that the window screen fails to filter out the fine dust outside.

Referring to Korean Patent No. 10-1757187 and Korean Patent No. 10-1792228, a fine dust blocking apparatus in the related art is shown. Referring to the documents, the fine dust blocking apparatus in the related art is described.

FIGS. 1 to 4 show a fine dust blocking apparatus in related art. Reference numerals in figures are applied only to the description in FIGS. 1 to 4.

As shown in FIGS. 1 and 2, a fine dust blocking apparatus disclosed in Korean patent No. 10-1757187 forms a water curtain by water-spraying to block fine dust flowing from an outside of an window screen.

In this case, an outer louver 561 of the fine dust blocking apparatus is vertically disposed in a blocking frame 510 and a lower end of each of the outer louvers is inclined inward and downward with respect to an window screen frame 300.

An inner louver 562 is disposed inside the blocking frame 510 and is symmetrical with each of the outer louvers 561 and a lower end of the inner louver is inclined outward and downward with respect to the window screen frame 300.

When the lower end of the outer louver 561 is disposed above the lower end of the inner louver 562, water sprayed through a spray nozzle 550 flows along an inclined surface of the outer louver 561, the water dropped from the lower end of the outer louver 561 flows along an inclined surface of the inner louver 562, and the water dropped from the lower end of the inner louver 562 flows again along the inclined surface of the outer louver 561. Therefore, the fine dust blocking apparatus may prevent the inflow of the fine dust by forming the water curtain.

However, the fine dust blocking apparatus has a problem that excessive power consumption occurs because water may be continuously drawn up and circulated, and water may be heated to prevent freezing of water at sub-zero temperatures.

In addition, the fine dust blocking apparatus has a problem that the fine dust blocking apparatus causes odors and stench due to the repeated use of the water, thereby requiring periodic washing.

For example, as shown in FIGS. 3 and 4, a fine dust blocking apparatus according to the Korean Patent No. 10-1792228 includes a first frame 10 having a window frame shape, a mesh unit 100 disposed in the first frame 10 and having a grid pattern, a conduction unit 200 disposed along the grid pattern of the mesh unit 100, and a power supply 300 connected to the conduction unit 200.

In this case, the dust blocking window screen may collect the dust passing through the mesh unit 100 using static electricity generated based on a micro-current flowing through the conduction unit 300. The fine dust blocking apparatus may block the fine dust based only on the static electricity without using water and may be operated with less power.

However, there is a problem in that, as the fine dust blocking apparatus applies a power having a predetermine level to the conduction unit 200 regardless of wind strength or an amount of fine dust, when the wind has a strong strength or a large amount of fine dust is introduced, the fine dust blocking apparatus may not properly collect the fine dust.

DISCLOSURE

Technical Problem

The present disclosure provides a window-type dust collecting apparatus to effectively block an inflow of fine dust by adjusting a magnitude of power applied according to external environmental factors.

The present disclosure also provides a window-type dust collecting apparatus to operate as a dehumidifier based on a difference between an outdoor temperature and an indoor temperature and a difference between outdoor humidity and indoor humidity and effectively block the fine dust based on moisture generated during the dehumidification process.

The present disclosure further provides a window-type dust collecting apparatus capable of self-cleaning of a dust collector.

The objects of the present disclosure are not limited to the above-mentioned objects and other objects and advantages of the present disclosure which are not mentioned may be understood by the following description and more clearly understood by the embodiments of the present disclosure. It will also be readily apparent that the objects and the advantages of the present disclosure may be implemented by features described in claims and a combination thereof.

Technical Solution

According to the present disclosure, a window-type dust collecting apparatus may adjust an intensity of power applied to a dust collector based on a wind speed or a fine dust concentration measured by the sensor to optimize power used to block the fine dust.

In addition, according to the present disclosure, the window-type dust collecting apparatus includes a dew point sensor to detect a dew-point temperature and a controller to lower a surface temperature of the dust collector than a dew-point temperature, thereby dehumidifying introduced air.

In addition, according to the present disclosure, the window-type dust collecting apparatus includes a rain sensor to measure an amount of rain and a controller to adjust an angle of the dust collector based on the measured amount of rain and open a water channel disposed under the dust collector, thereby self-cleaning the dust collector.

Advantageous Effects

According to the present disclosure, a window-type dust collecting apparatus may adjust a magnitude of power applied based on a wind speed of air introduced from outside or an amount of fine dust to effectively block an inflow of the fine dust with minimal power. Therefore, the window-type dust collecting apparatus may reduce power consumption to save energy and minimize maintenance costs to reduce economic burden of users.

In addition, according to the present disclosure, the window-type dust collecting apparatus may operate as a dehumidifier by controlling humidity of air introduced from the outside based on a difference between an outdoor temperature and an indoor temperature and a difference between outdoor humidity and indoor humidity. The window-type dust collecting apparatus may adjust the indoor humidity without an additional dehumidifier, thereby improving an operating efficiency of the apparatus. In addition, the window-type dust collecting apparatus may effectively block fine dust using moisture generated during the dehumidification process.

In addition, according to the present disclosure, as the window-type dust collecting apparatus enables self-cleaning of the dust collector using the moisture generated during the dehumidification process, a cleaning time of the dust collecting apparatus may be increased to improve user convenience. In addition, when it rains outside, dust in the dust collector may be removed by rainwater by adjusting the angle of the dust collector, thereby effectively managing the dust collecting apparatus.

Further to the effects described above, specific effects of the present disclosure are described together while describing detailed matters for implementing the present disclosure.

BEST MODE

Figure 1:
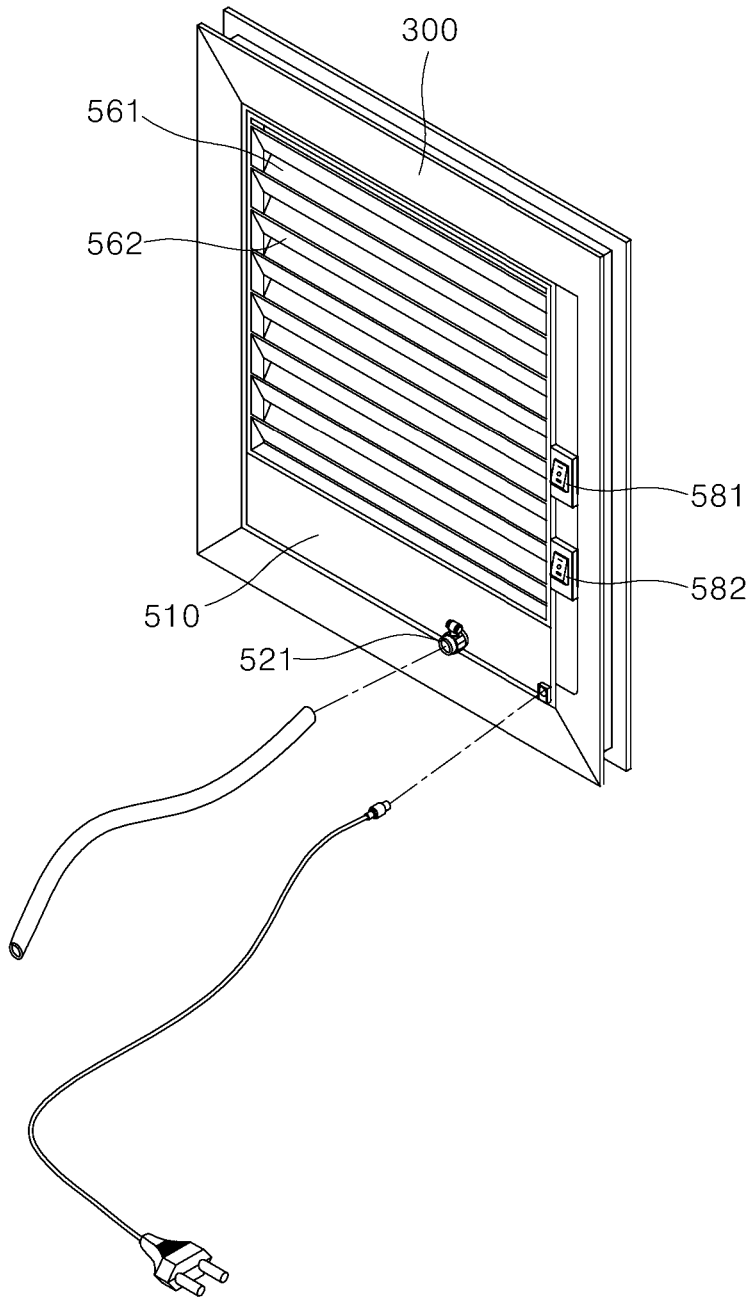
FIGS. 1 to 4 show a fine dust blocking apparatus in related art.
Figure 2:
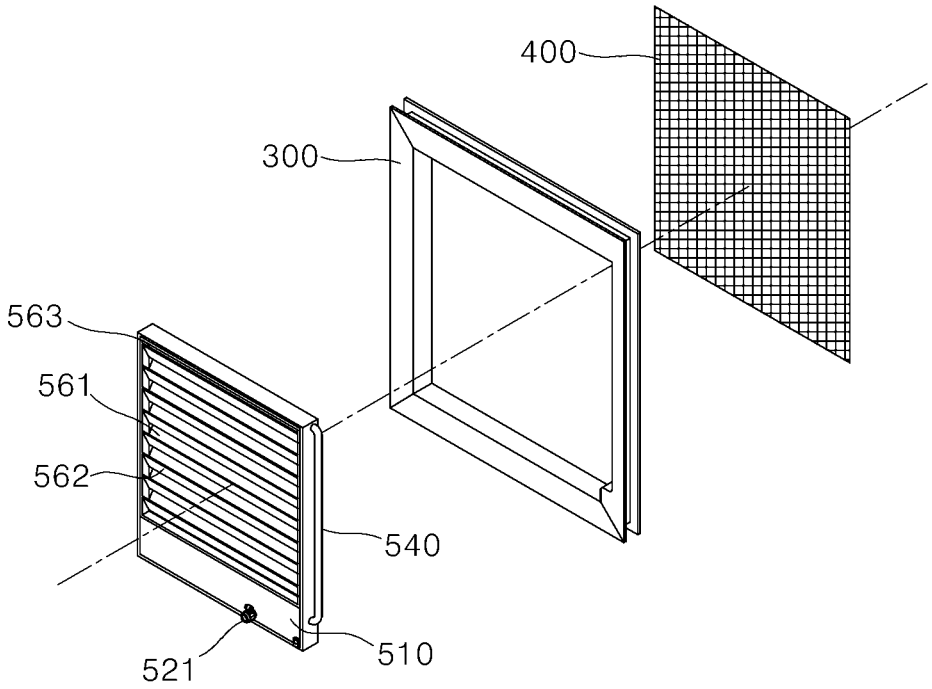
Figure 3:
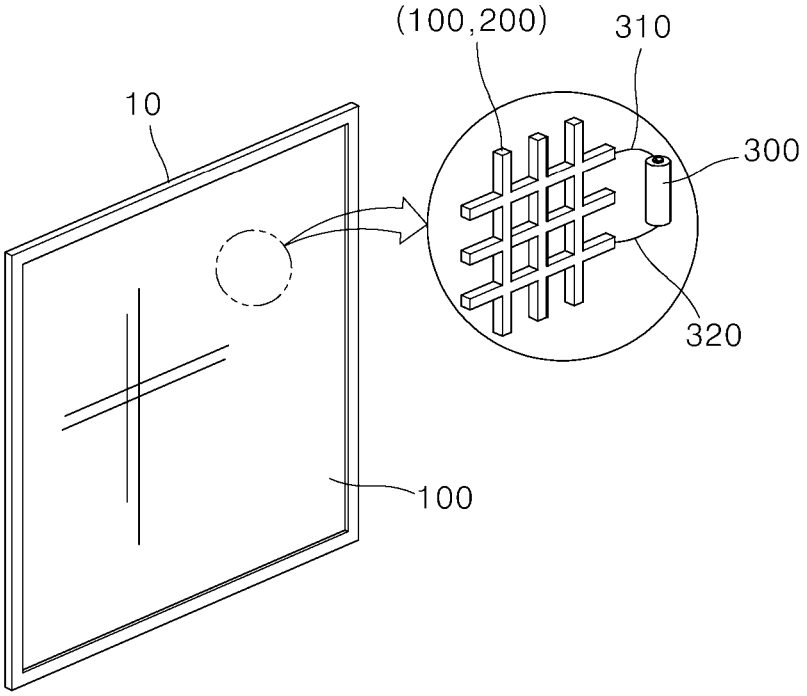
Figure 4:
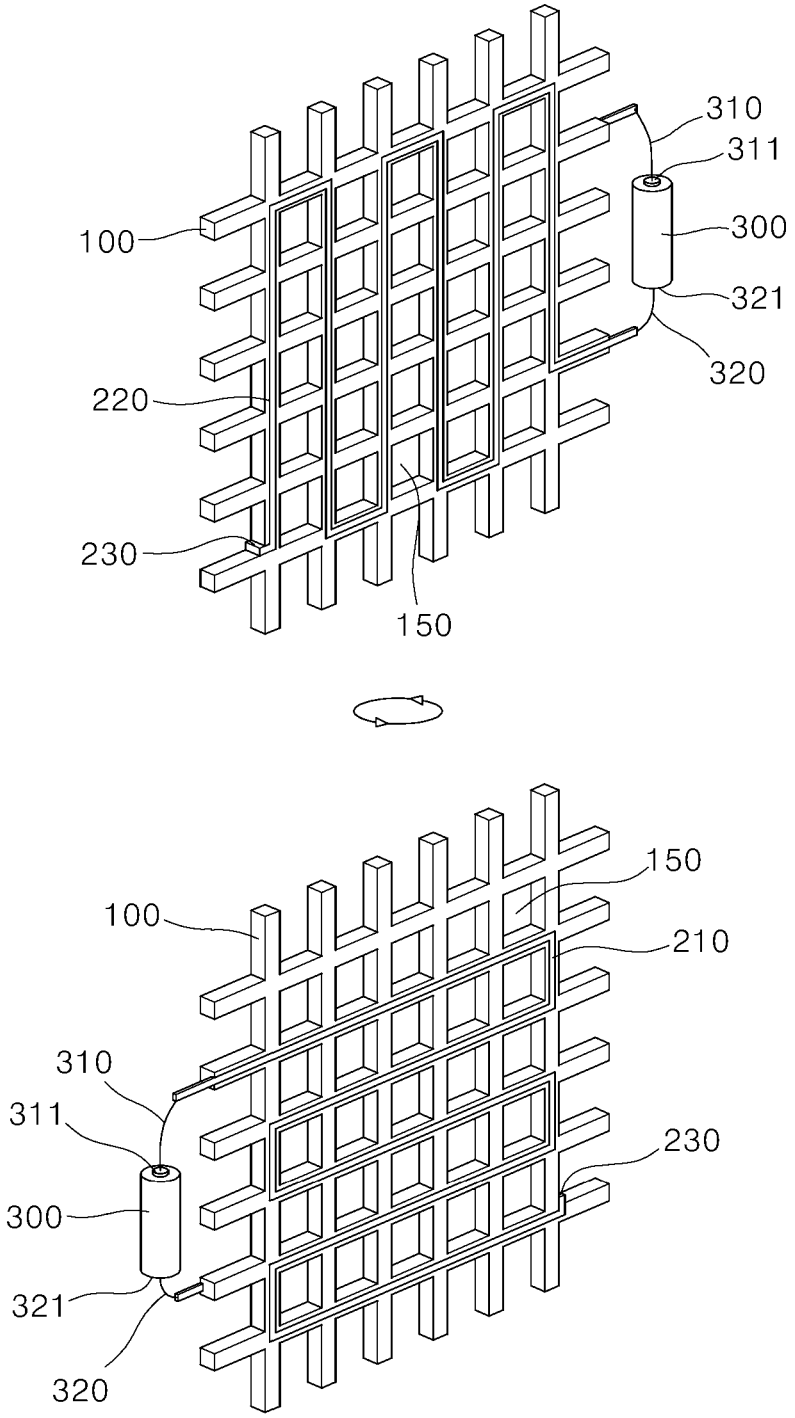

It should be understood that the terms and words used herein and the appended claims should not be construed as limited to general and dictionary meanings, but interpreted based on the meanings and concepts corresponding to technical idea of the present disclosure on the basis of the principle that the inventor is allowed to define terms appropriately for the best explanation. In addition, since embodiments described herein and constructions illustrated in the drawings are only exemplary embodiments of the present disclosure and do not mean all of the technical idea of the present disclosure, it will be understood that various equivalents and modifications as alternatives of the embodiments can be made at the filing of the present disclosure.

Hereinafter, a window-type dust collecting apparatus according to an embodiment of the present disclosure is described in detail with reference to FIGS. 5 to 17.

Figure 5:
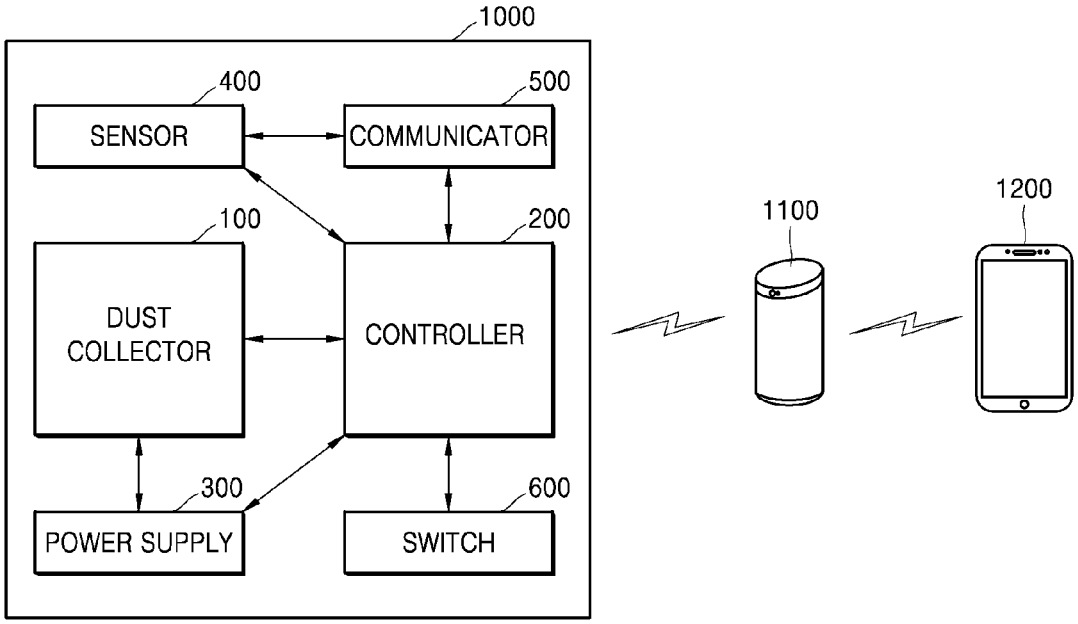
FIG. 5 is a block diagram showing a window-type dust collecting apparatus according to an embodiment of the present disclosure.

FIG. 5 is a block diagram showing a window-type dust collecting apparatus according to some embodiments of the present disclosure.

Referring to FIG. 5, a window-type dust collecting apparatus 1000 according to some embodiments of the present disclosure includes a dust collector 100, a controller 200, a power supply 300, a sensor 400, a communicator 500, and a switch 600.

The dust collector 100 collects dust or fine dust contained in the wind introduced into the window-type dust collecting apparatus 1000. The dust collector 100 includes a first dust collecting plate 110 that is negatively conducted and a second dust collecting plate 120 that is positively conducted. In this case, an electromagnetic field is generated on each of the first dust collecting plate 110 and the second dust collecting plate 120 based on electric charge.

When the fine dust is introduced, the first dust collecting plate 110 pushes out the negatively-charged fine dust based on the electromagnetic field generated by the first dust collecting plate 110. For example, the first dust collecting plate 110 adsorbs positively-charged fine dust.

For example, when the fine dust is introduced, the second dust collecting plate 120 pushes out the positively-charged fine dust to the outside based on an electromagnetic field generated by the second dust collecting plate 120 and adsorbs the negatively-charged fine dust.

The first dust collecting plate 110 may be disposed closer to an inlet through which the wind is introduced than the second dust collecting plate 120. In this case, as the incoming wind passes through the first dust collecting plate 110, the first dust collecting plate 110 pushes out the negatively-charged fine dust contained in the wind and adsorbs the positively-charged fine dust. For example, the first dust collecting plate 110 filters the fine dust contained in the wind that is primarily introduced.

The fine dust passing through the first dust collecting plate 110 is secondarily filtered by the second dust collecting plate 120 due to the wind speed or a high concentration of fine dust.

In this case, the negatively-charged fine dust passing through the first dust collecting plate 110 may be adsorbed on the second dust collecting plate 120 and the positively-charged fine dust may move to the first dust collecting plate 110 by the repulsive force of the electromagnetic field generated by the second dust collecting plate 120 and be adsorbed on the first dust collecting plate 110.

For example, the arrangement of the first dust collecting plate 110 and the second dust collecting plate 120 may be changed.

Figure 13:
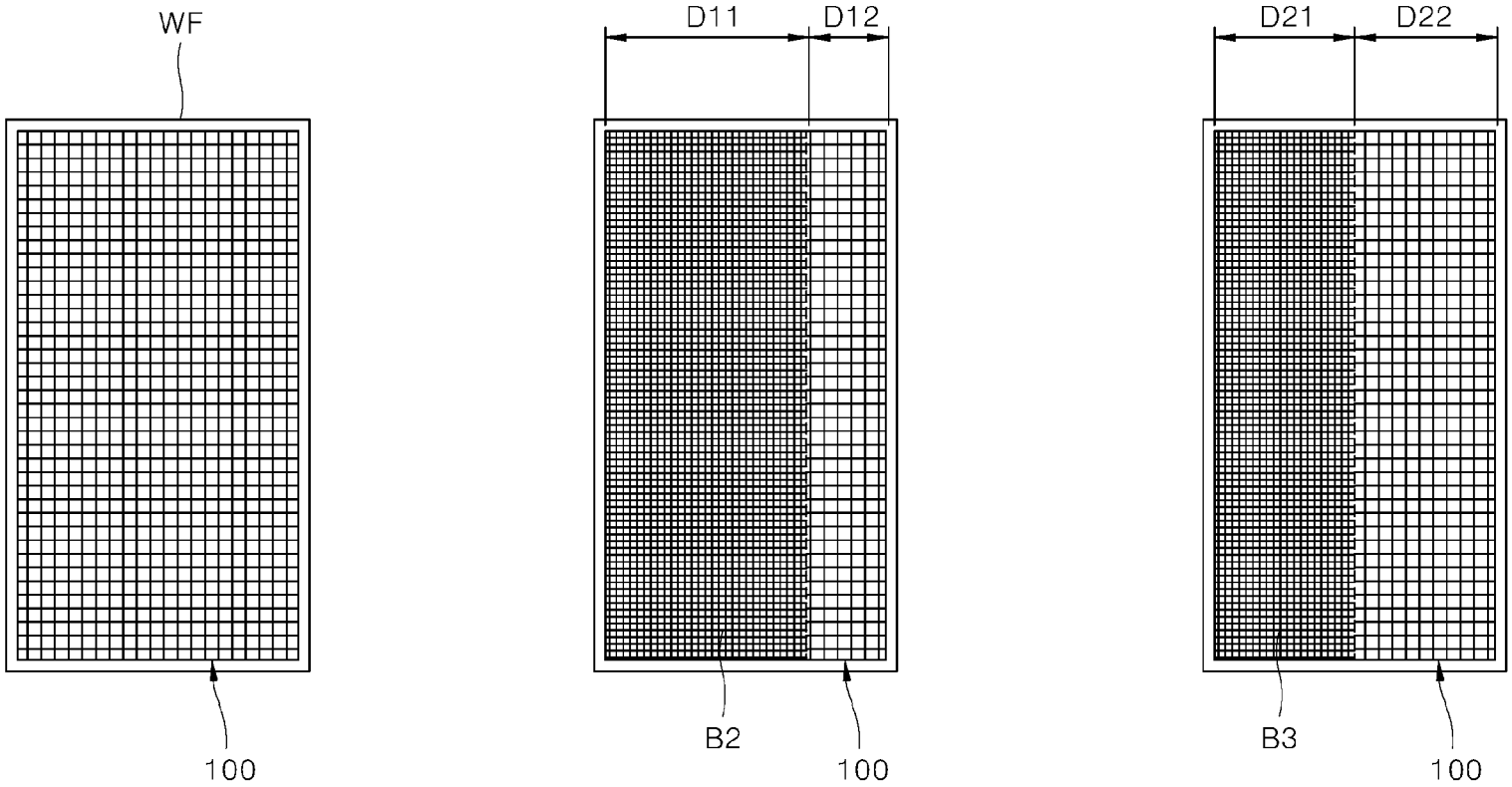
FIG. 13 shows a dust collector of a window-type dust collecting apparatus according to an embodiment of the present disclosure.

The dust collector 100 may be disposed on an opening of a dust collecting frame WF (see FIG. 13). In this case, the dust collector 100 may be disposed within the dust collecting frame WF at a predetermined ratio with an window screen in related art. Hereinafter, details thereof are described with reference to FIG. 13.

The controller 200 determines whether power is applied to the dust collector 100 and controls an intensity of the applied power. In this case, the controller 200 may control the intensity of the power applied to the dust collector 100 based on external environmental factors. Examples of external environmental factors may include an outdoor temperature, outdoor humidity, a wind speed, an amount of fine dust, and rainfall (an amount of rain).

The controller 200 receives data on external environmental factors measured by the sensor 400 and controls a magnitude of power applied to the dust collector 100 based on the received data.

For example, when the wind has the high speed or the fine dust has an increased concentration, the controller 200 may increase the magnitude of the power applied to the dust collector 100 to effectively filter the introduced fine dust.

For example, when the wind speed decreases or the concentration of fine dust decreases, the controller 200 may reduce the magnitude of the power applied to the dust collector 100 to reduce power consumption of the window-type dust collecting apparatus 1000, thereby increasing energy efficiency.

In this case, the controller 200 may determine the power consumption and a magnitude of electromagnetic force under a condition in which ultra-fine dust of a predetermined size or less (e.g., 2.5 μm) may not pass to calculate the power applied to the dust collector 100. Therefore, the window-type dust collecting apparatus 1000 may be operated with optimum energy efficiency.

In addition, when a dust removal signal is input from a user, the controller 200 instantaneously applies a positive current to the first dust collecting plate 110, applies a negative current to the second dust collecting plate 120, and then turns off the power.

The controller 200 may control the dust collector 100 to perform self-cleaning by pushing and dropping the dust adsorbed on the dust collector 100.

The control method of the controller 200 based on the dust removal signal is only an example, and the present disclosure may be variously modified and implemented.

In addition, when the sensor 400 detects a bug, the controller 200 may instantaneously apply high voltage to the dust collector 100 to electrically shock the bug, thereby preventing entry of the bug.

The power supply 300 provides power to the dust collector 100. The power supply 300 may provide the dust collector 100 with each of the positive current and the negative current. For example, the power supply 300 provides the first dust collecting plate 110 with the negative current to negatively charge a surface of the first dust collecting plate 110. In addition, the power supply 300 provides the second dust collecting plate 120 with the positive charge to positively charge a surface of the second dust collecting plate 120.

The power supply 300 includes a battery. In this case, the battery may be removable and replaceable.

The power supply 300 may be disposed inside or at one side of the dust collection frame WF, is charged based on an external power supply connected through a wired port, or continuously powers each of the components of the window-type dust collecting apparatus 1000 by replacing the battery.

The sensor 400 includes a plurality of sensors to detect external environmental factors. For example, the sensor 400 may include a blow sensor to measure a wind speed of the wind flowing into the dust collector 100, a fine dust sensor to measure a size and a concentration of fine dust, a temperature and humidity sensor to measure an outdoor temperature and outdoor humidity, and a rain sensor to measure the amount of rain.

The sensor 400 may further include various types of sensors.

The data measured by the sensor 400 is transmitted to the controller 200 and is used to control the magnitude of power applied to the dust collector 100 or an operation thereof.

In addition, the communicator 500 may transmit the data measured by the sensor 400 to an external apparatus.

The communicator 500 transmits and receives data to and from other apparatuses via a wire or wirelessly. The data may include sensing data measured by the sensor 400 (e.g., the outdoor temperature and humidity, a wind speed, a concentration of fine dust, the amount of rain, and the like), an operation state of the window-type dust collecting apparatus 1000, and the power consumption.

The communicator 500 may transmit the data to a user terminal 1200 through a hub terminal device 1100. In addition, the communicator 500 may receive a user's command from the hub terminal device 1100 or the user terminal 1200 and transmit the user's command to the controller 200.

In this case, the user may select the command for controlling the window-type dust collecting apparatus 1000 and the selected command is transmitted to the controller 200.

For example, the user may select a dust removal command of the window-type dust collecting apparatus 1000, and when the dust removal signal is received, the controller 200 may apply a power different from the power currently applied to the dust collector 100 and may turn off the power thereof. However, this is only an example, and the present disclosure is not limited thereto.

Wireless communication networks used by the communicator 500 may include local area network (WLAN), wireless fidelity (Wi-Fi), wireless broadband (Wibro), world interoperability for microwave access (Wimax), and high speed downlink packet access (HSDPA), long term evolution (LTE), IEEE802.16, and wireless mobile broadband service (WMBS).

In addition, a short-range wireless communication network used by the communicator 500 may include a beacon, Bluetooth, radio frequency identification (RFID), infrared data association (IrDA), ultra wideband (UWB), ZigBee, and Z-Wave. However, the present disclosure is not limited thereto.

The switch 600 detects opening or closing of a window on which the window-type dust collecting apparatus 1000 is disposed. The signal detected by the switch 600 is transmitted to the controller 200.

For example, a first electrode 610 of the switch 600 is disposed at one side of the dust collecting frame and the second electrode 620 is disposed at one side of the window to detect the opening or closing of the window when an electric current is applied to the first electrode 610 and the second electrode 620. Details thereof are described below with reference to FIGS. 11 and 12.

The window-type dust collecting apparatus 1000 may be connected to each of the hub terminal device 1100 and the user terminal 1200 by wire or wirelessly.

In this case, the hub terminal device 1100 may recognize a user's voice and transmit a user's voice recognition command to the window-type dust collecting apparatus 1000.

In addition, the hub terminal device 1100 may inform the user of information on external environmental factors (e.g., current outdoor temperature and humidity, wind speed, a concentration of fine dust, and the amount of rain) received from the window-type dust collecting apparatus 1000.

Similarly, the user terminal 1200 may select a control command for the window-type dust collecting apparatus 1000 using an application related to the window-type dust collecting apparatus 1000. In addition, the user terminal 1200 may receive and display state information of the window-type dust collecting apparatus 1000 and information on external environmental factors.

For reference, this is only an example and the hub terminal device 1100 and the user terminal 1200 may be used in various ways in connection with the window-type dust collecting apparatus 1000.

Figure 6:
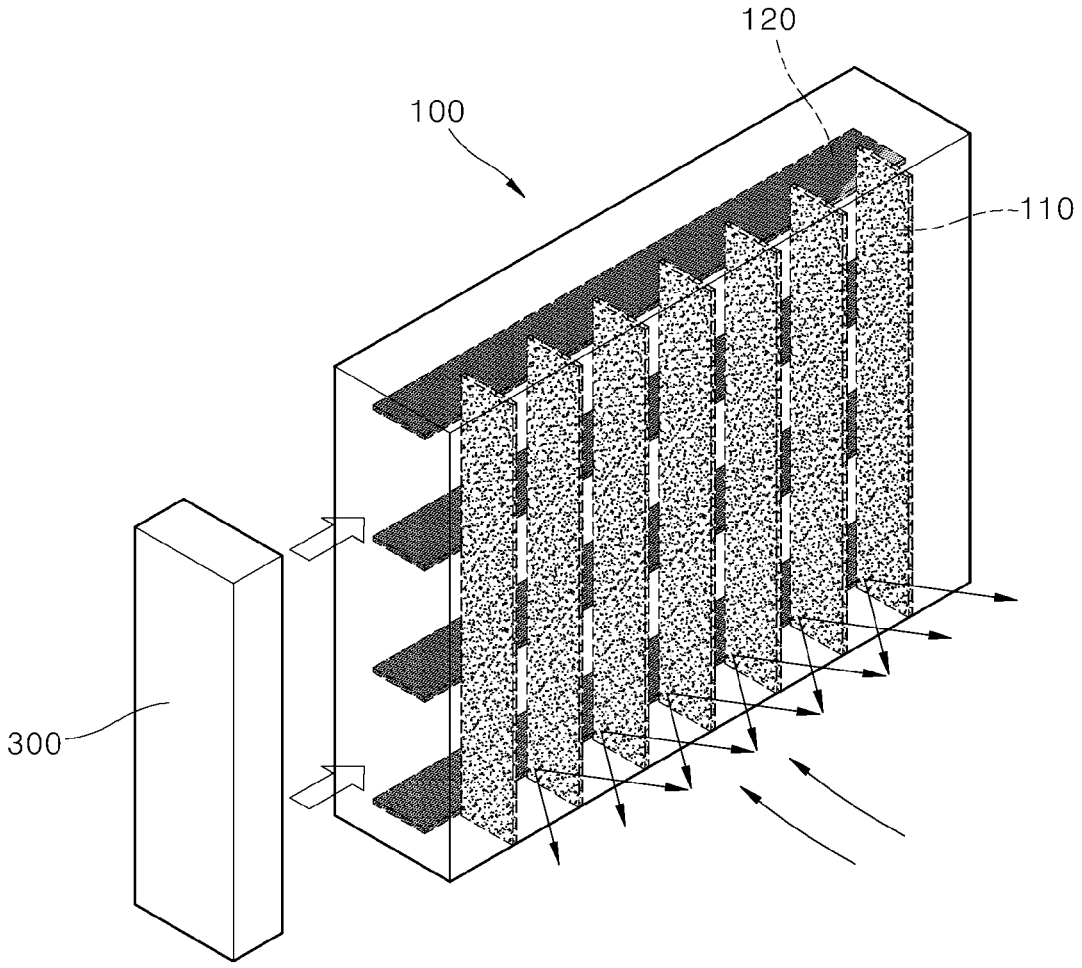
FIG. 6 is a partial perspective view showing a dust collector in FIG. 5.
Figure 7:
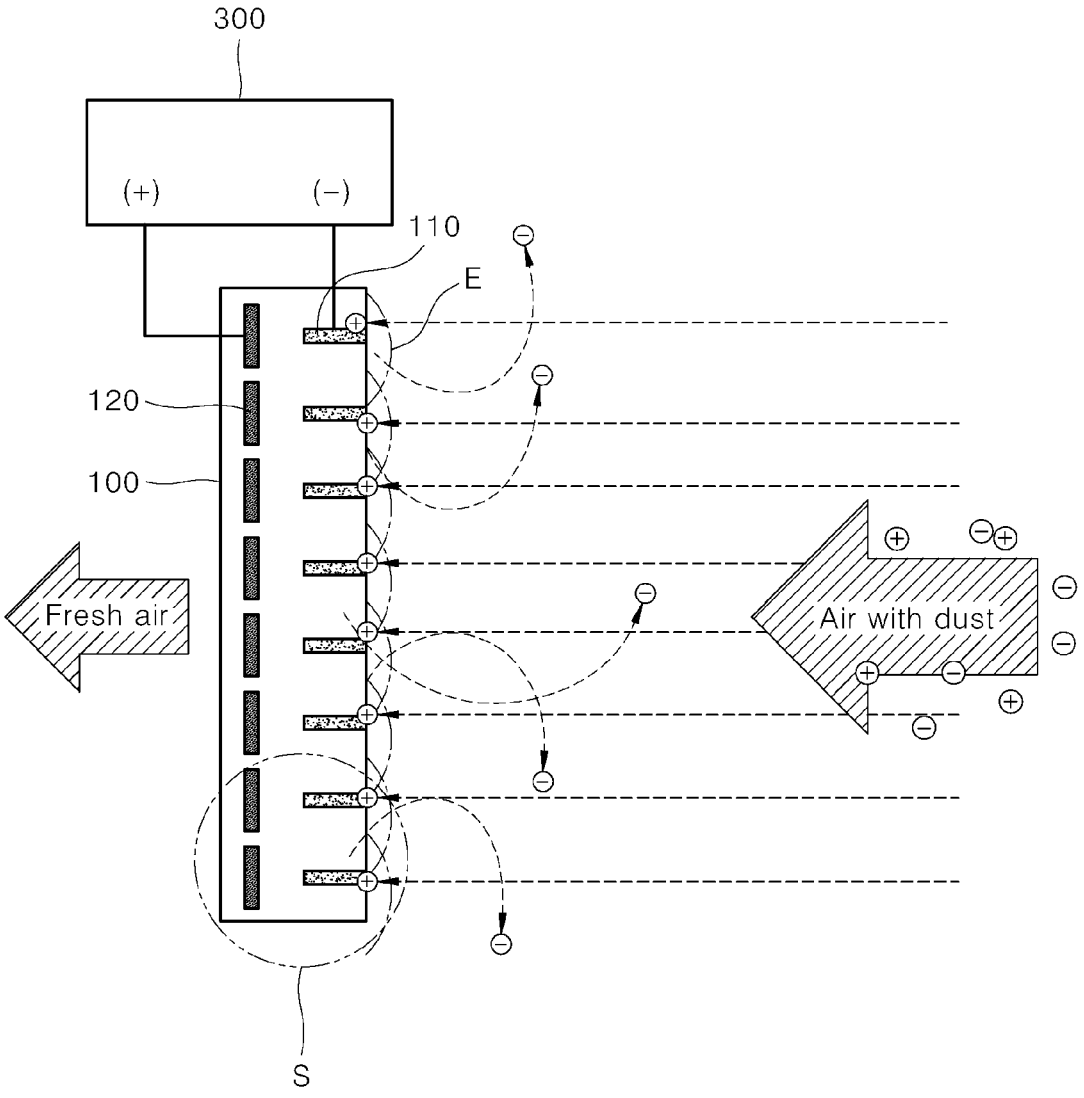
FIG. 7 is a conceptual diagram showing an operation of a dust collector in FIG. 5.
Figure 8:
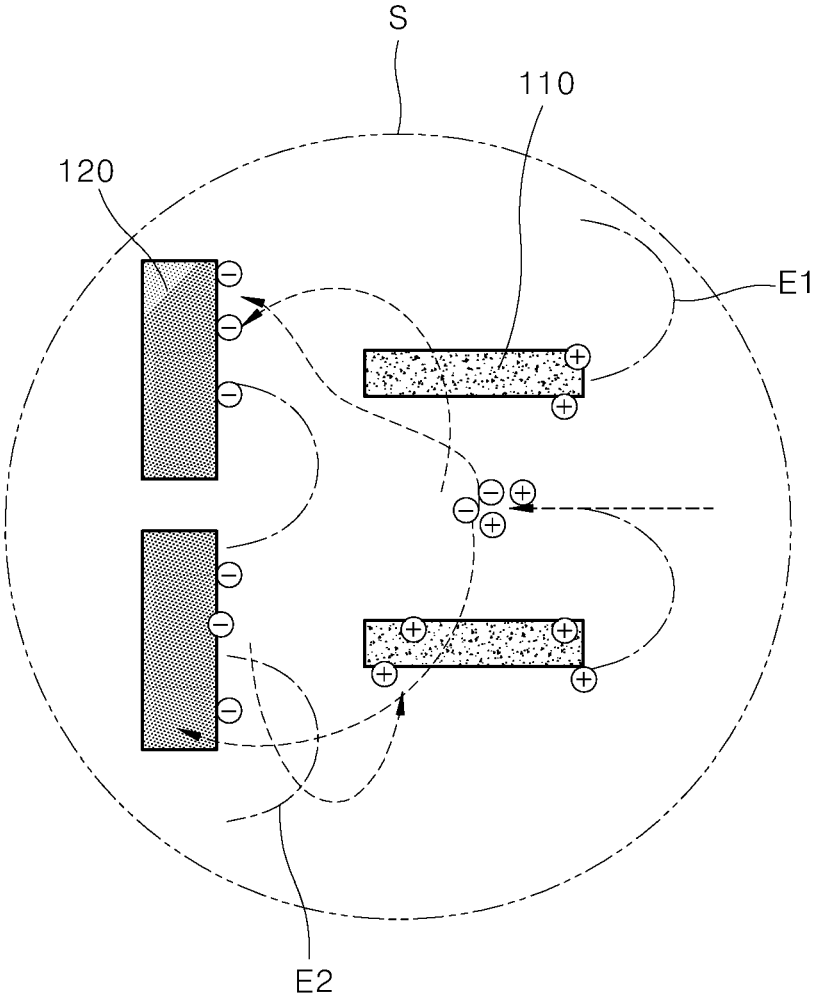
FIG. 8 is an enlarged view showing area S in FIG. 7.

FIG. 6 is a partial perspective view showing the dust collector in FIG. 5. FIG. 7 is a conceptual diagram showing an operation of the dust collector in FIG. 5. FIG. 8 is an enlarged view showing area S in FIG. 7.

Hereinafter, a principle of collecting dust of a window-type dust collecting apparatus 1000 is described with reference to FIGS. 6 to 8.

Referring to FIG. 6, the dust collector 100 includes a first dust collecting plate 110 including a plurality of first sub-dust collecting plates disposed in parallel in a first direction and a second dust collecting plate 120 including a plurality of second sub-dust collecting plates disposed parallel in a second direction.

The first direction and the second direction crosses with each other. In this case, the first direction and the second direction may be orthogonal to each other.

For example, the first dust collecting plate 110 includes the plurality of first sub-dust collecting plates extending vertically and the plurality of first sub-dust collecting plates are disposed at equal distances. In addition, the second dust collecting plate 120 includes a plurality of second sub-dust collecting plates extending horizontally and the plurality of second sub-dust collecting plates are disposed at equal distances.

In this case, the power supply 300 is electrically connected to the first dust collecting plate 110 to provide the first dust collecting plate 110 with the negative current and is electrically connected to the second dust collecting plate 120 to provide the second dust collecting plate 120 with the positive current.

The power supply 300 is disposed at one side of the dust collector 100 and may be mounted in the dust collecting frame WF, although not clearly shown in the drawings.

Referring to FIGS. 7 and 8, wind flowing into a dust collector 100 from outside contains fine dust. In this case, the fine dust contains negatively-charged particles or positively-charged particles.

The wind flowing into the dust collector 100 passes through the first dust collecting plate 110 and then passes through the second dust collecting plate 120.

In this case, the first dust collecting plate 110 is connected to a negative current to negatively charge a surface of the first dust collecting plate 110. A magnetic field (E1) is generated on the first dust collecting plate 110 to push out negatively-charged particles among the fine dust of the wind introduced from the outside.

For example, the positively-charged particles of the fine dust of the wind introduced from the outside are adsorbed on the surface of the first dust collecting plate 110.

For example, the second dust collecting plate 120 is connected to the positive current to positively charge a surface of the second dust collecting plate 120. In this case, the second dust collecting plate 120 adsorbs the negatively-charged particles from the fine dust passing through the first dust collecting plate 110.

For example, the positively-charged particles of the fine dust that have passed through the first dust collecting plate 110 move outward by a repulsive force of a magnetic field (E2) generated around the second dust collecting plate 120. For example, the second dust collecting plate 120 changes a movement path of the positive charge to collect the positive charge on the first dust collecting plate 110.

That is, the dust collector 100 may collect the fine dust of the wind introduced from the outside to filter the fine dust of the wind passing through the dust collector 100.

In this case, the intensity of the electric power applied to the dust collector 100 may vary based on a wind speed of the wind introduced into the dust collector 100 and an amount of fine dust contained in the wind.

For example, when the wind speed is high or the concentration of fine dust increases, the controller 200 increases the magnitude of the power applied to the dust collector 100 to increase the intensity of magnetic field generated on the at least one of the first dust collecting plate 110 or the second dust collecting plate 120, thereby effectively filtering the fine dust introduced inside.

For example, when the wind speed decreases or the concentration of fine dust decreases, the controller 200 reduces the magnitude of power applied to the dust collector 100 to reduce power consumption of the window-type dust collecting apparatus 1000 and increase energy efficiency.

Figure 9:
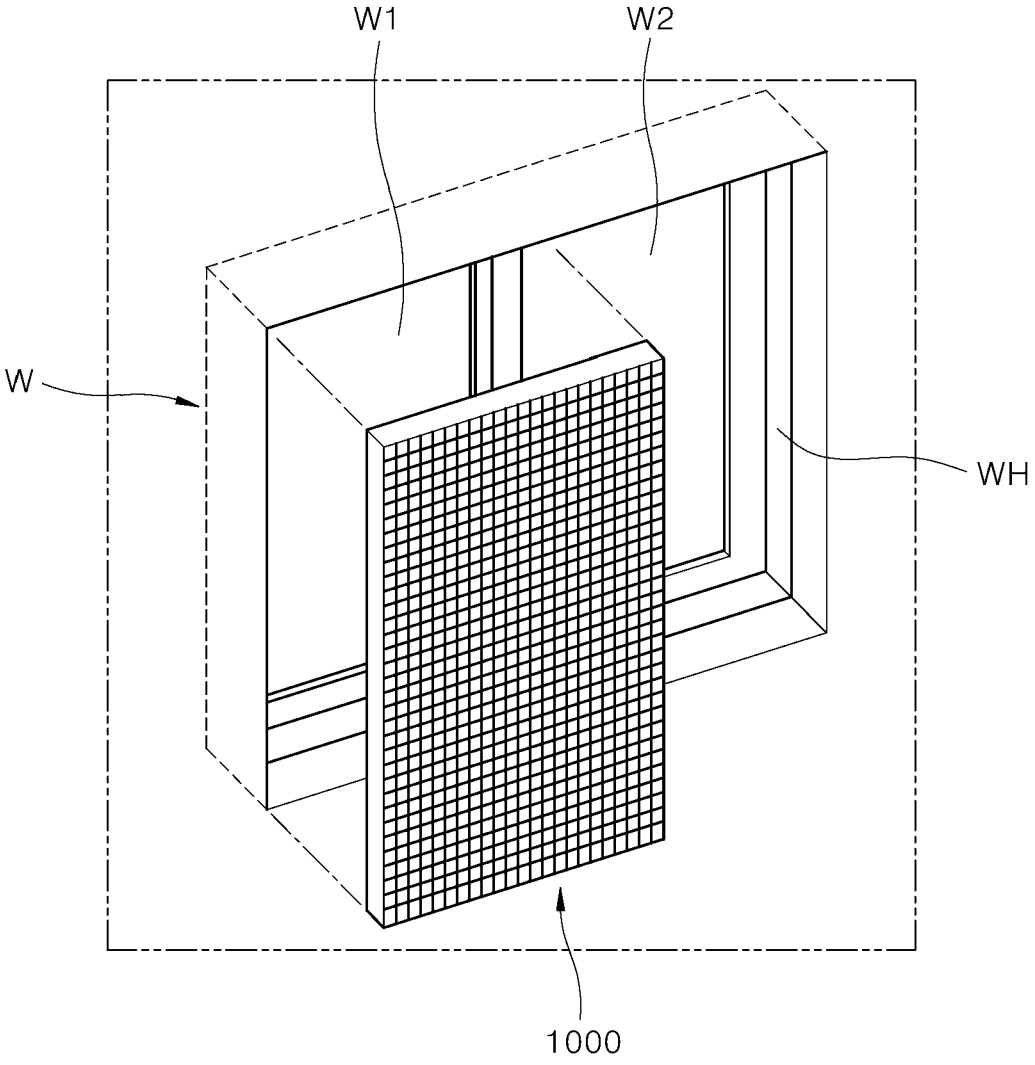
FIGS. 9 and 10 show a method of installing a window-type dust collecting apparatus according to an embodiment of the present disclosure.
Figure 10:
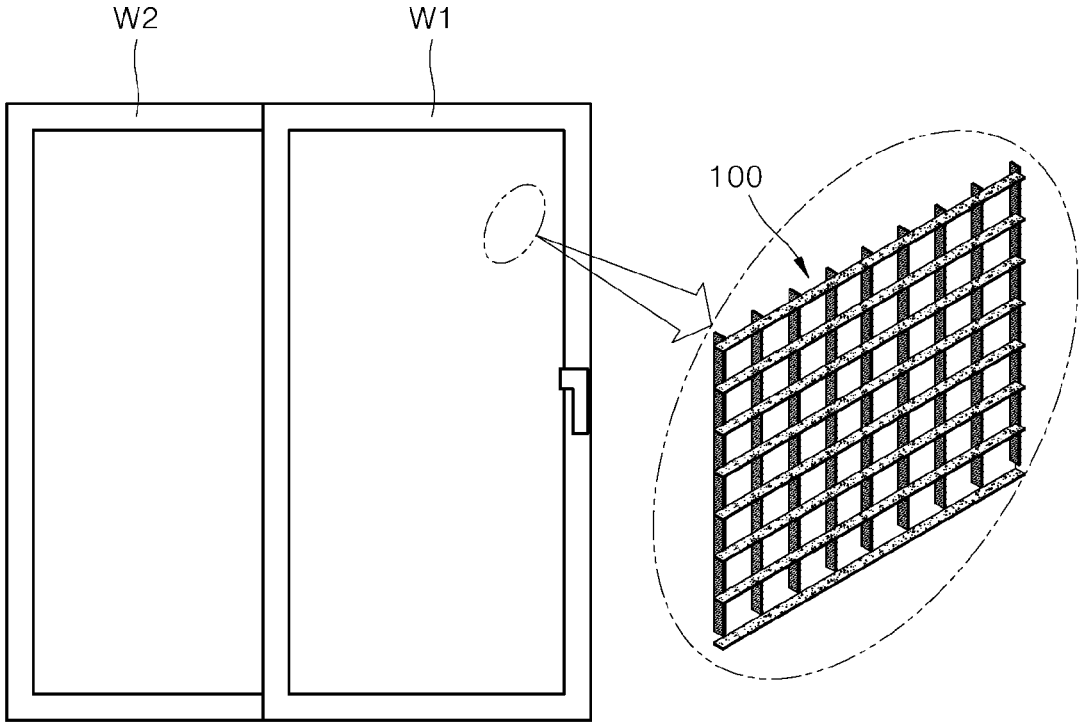
Figure 11:
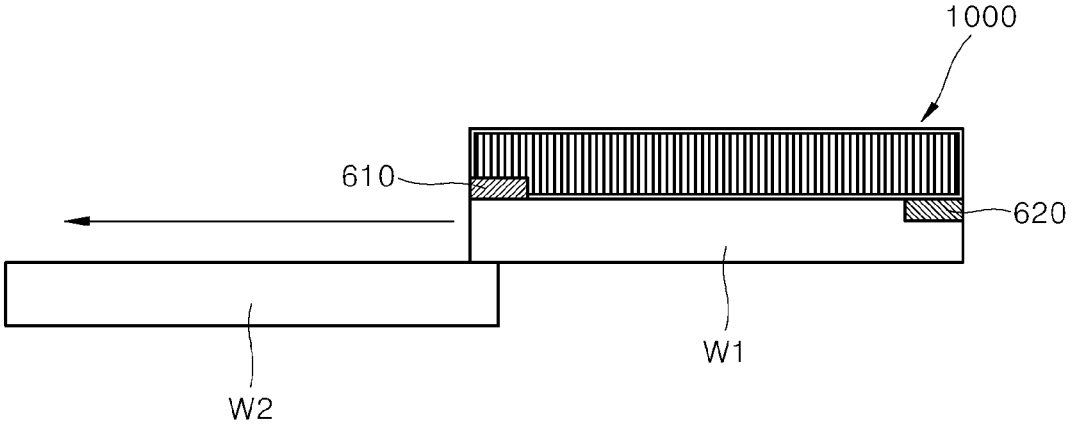
FIGS. 11 and 12 show operation of a switch of a window-type dust collecting apparatus according to an embodiment of the present disclosure.
Figure 12:
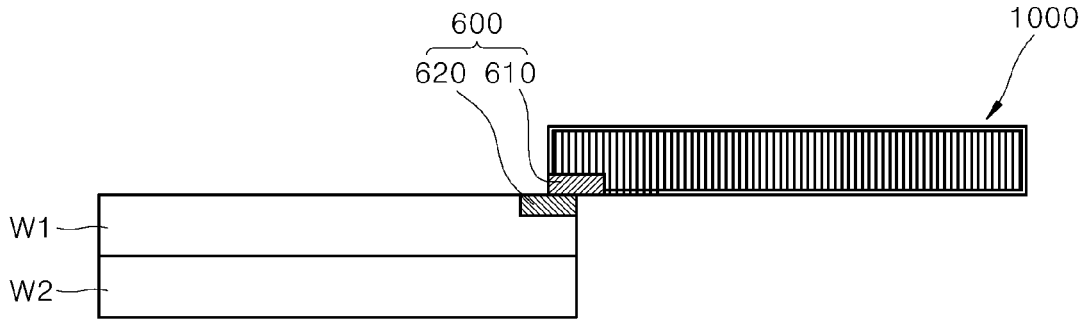

FIGS. 9 and 10 show a method of installing a window-type dust collecting apparatus according to an embodiment of the present disclosure. FIGS. 11 and 12 show an operation of a switch of a window-type dust collecting apparatus according to an embodiment of the present disclosure.

Referring to FIGS. 9 and 10, a window-type dust collecting apparatus 1000 of the present disclosure may be disposed at one side of the window W.

For example, the window W includes a window frame WH to define appearance of the window frame, a first window W1 and a second window W2 slidably disposed inside the window frame WH to open and close the window frame WH.

When the first window W1 overlaps with the second window W2, the window W may be opened to introduce outside air into an indoor space. For example, when the first window W1 and the second window W2 do not overlap with each other, the window W is closed to block inflow of external air.

The window-type dust collecting apparatus 1000 is disposed at one side of at least one of the first window W1 or the second window W2. When the first window W1 or the second window W2 is opened, the window-type dust collecting apparatus 1000 may introduce the outdoor air through an opening.

Although not clearly shown in the drawings, the window-type dust collecting apparatus 1000 includes a dust collecting frame WF to couple the dust collector 100 to the window frame WH.

In this case, the dust collector 100 described above is disposed on the opening of the dust collecting frame WF and a body of the dust collecting frame WF includes the controller 200, the power supply 300, the sensor 400, and the communicator 500, and the switch 600 described above.

The window-type dust collecting apparatus 1000 may be overlapped with at least one of the first window W1 or the second window W2. Hereinafter, an example case is described in which a window-type dust collecting apparatus 1000 overlaps with a first window W1.

Referring to FIGS. 11 and 12, a window-type dust collecting apparatus 1000 includes a switch 600 to detect whether the window W is opened or closed.

The switch 600 includes a first electrode 610 and a second electrode 620.

The first electrode 610 of the switch 600 is disposed at one side of the dust collecting frame WF and the second electrode 620 is disposed at one side of the first window W1. In this case, the first electrode 610 and the second electrode 620 may be disposed on surfaces of the dust collecting frame WF and the first window W1 facing each other, respectively.

When the first window W1 and the second window W2 are not overlapped with each other and are closed to block outside air from entering inside the window W, the first electrode 610 is spaced apart from the second electrode 620.

For example, when the first window W1 and the second window W2 overlap with each other and are opened to introduce external air into the window W, the first electrode 610 may contact the second electrode 620.

The controller 200 detects whether the first electrode 610 contacts the second electrode 620 and determines whether the window W is opened or closed. For example, the controller 200 may determine whether the first electrode 610 contacts the second electrode 620 based on a change in a resistance value or a current value of the switch 600.

For reference, this is only an example, and the switch 600 and the controller 200 may each determine the opening and the closing of the window W in various ways.

When the window W is closed (see FIG. 11), the controller 200 does not apply the power to the dust collector 100 and turns off the operation of the window-type dust collecting apparatus 1000.

For example, when the window W is opened (see FIG. 12), the controller 200 applies the power to the dust collector 100 and collects fine dust contained in the wind flowing from the outside.

FIG. 13 shows a dust collector of a window-type dust collecting apparatus according to an embodiment of the present disclosure.

Referring to FIG. 13, a dust collector 100 or a window screen is disposed on a dust collecting frame WF of a window-type dust collecting apparatus 1000 according to an embodiment of the present disclosure at a predetermined ratio.

In an example of the window-type dust collecting apparatus 1000, referring to type <A>, only a dust collector 100 is disposed on an opening of the dust collecting frame WF. For example, the window-type dust collecting apparatus 1000 does not include the window screen and may include only the dust collector 100 at the opening of the dust collecting frame WF.

For example, in another example of the window-type dust collecting apparatus 1000, the dust collector 100 and the window screen are disposed on the opening of the dust collecting frame WF at the predetermined ratio.

Referring to type <B>, a window screen B2 and a dust collector 100 may each be disposed on an opening of the dust collecting frame WF. In this case, a width of the window screen B2 may be greater than a width of the dust collector 100. For example, a width (D11) of the window screen and a width (D12) of the dust collector 100 may have a ratio of 3:1.

In addition, referring to type <C>, an window screen B3 and a dust collector 100 may each be disposed at an opening of a dust collecting frame WF and the window screen B3 may have a width similar to that of the dust collector 100 or the dust collector 100 may have a greater width than that of the window screen B3. For example, the width D21 of the window screen and the width D22 of the dust collector 100 may have a ratio of 1:1.

In types <B> and <C>, as an area of the dust collector 100 is reduced, power use to operate the dust collector 100 may also be reduced, compared to the type <A>.

For example, a user slightly opening the window W may economically and effectively used the window-type dust collecting apparatus 1000 of the type <B> or type <C> than the type <A>. Accordingly, the user may select and use at least one of the type <A> to the type <C> according to a house structure.

Figure 14:
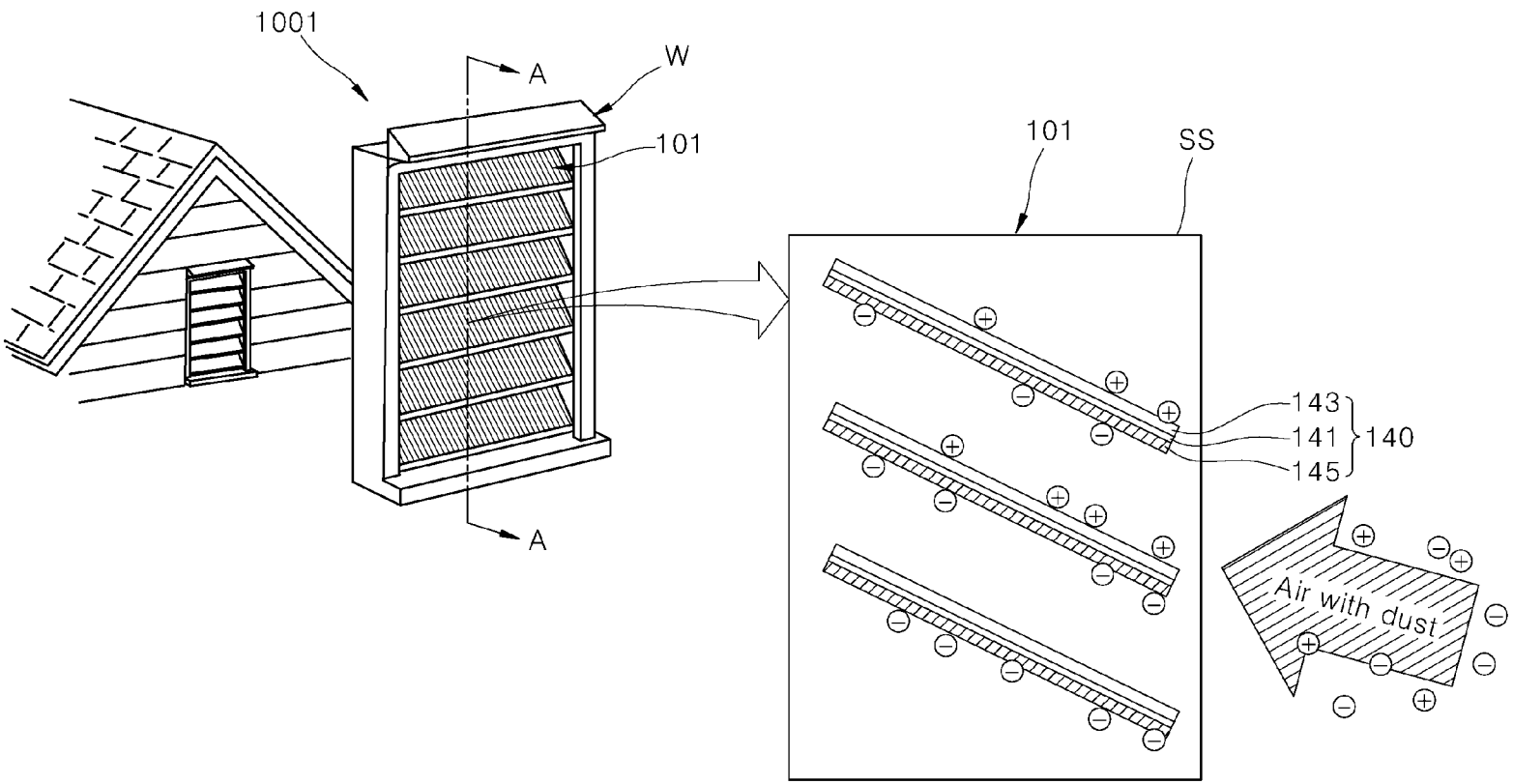
FIGS. 14 and 15 show a window-type dust collecting apparatus according to another embodiment of the present disclosure.
Figure 15:
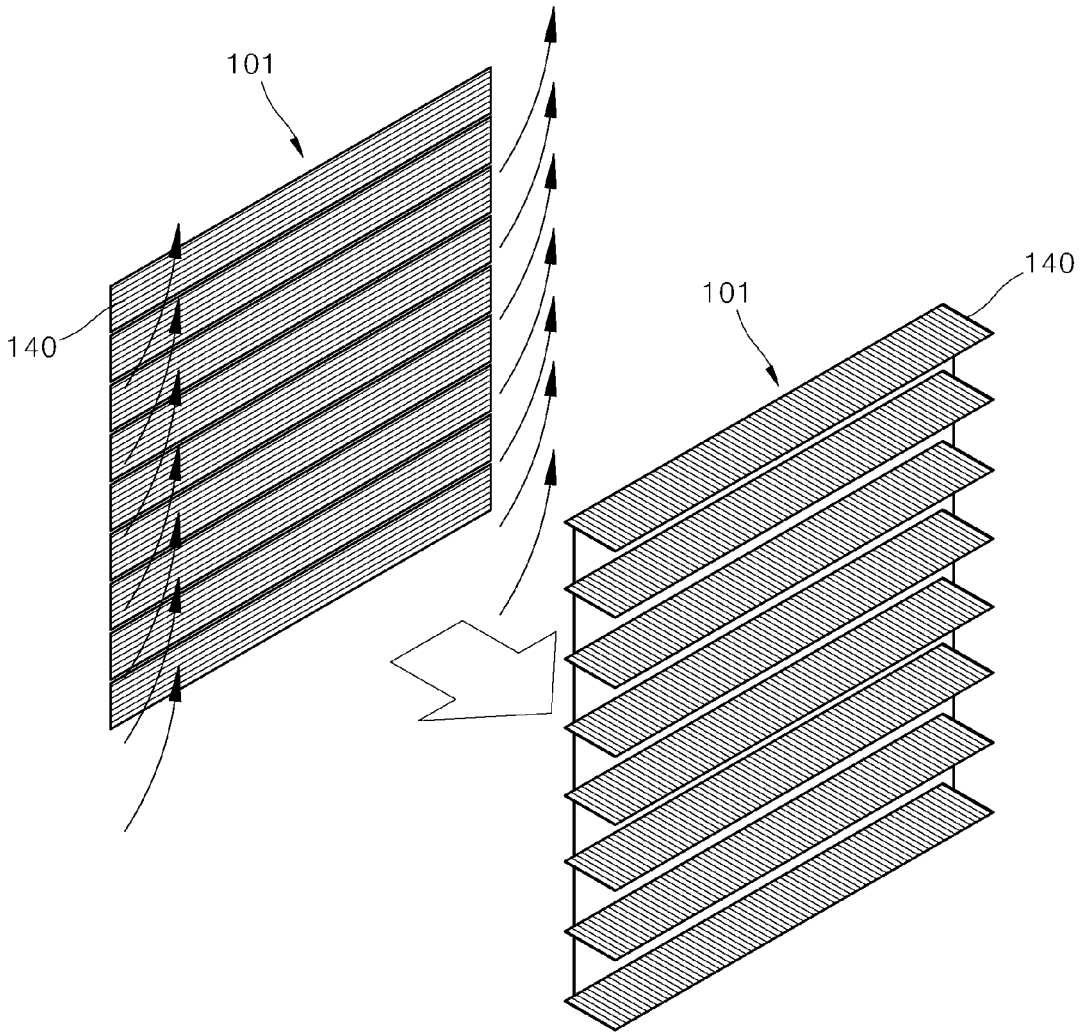

FIGS. 14 and 15 show a window-type dust collecting apparatus according to another embodiment of the present disclosure. Region SS in FIG. 14 represents a cross-section taken along line A-A.

Hereinafter, contents overlapping with the contents of the window-type dust collecting apparatus described above are omitted and differences are described.

Referring to FIGS. 14 and 15, a dust collector 101 of a window-type dust collecting apparatus 1001 according to another embodiment of the present disclosure includes a plurality of dust collecting structures 140.

The dust collecting structure 140 includes a base 141, a first dust collecting plate 143 disposed on a first surface of the base 141, and a second dust collecting plate 145 disposed on a second surface of the base 141.

The first dust collecting plate 143 and the second dust collecting plate 145 operate substantially in the same manner as the first dust collecting plate 110 and the second dust collecting plate 120 described above.

For example, the first dust collecting plate 143 is connected to a positive current and is negatively conducted to push out negatively-charged fine dust to outside and collect positively-charged fine dust.

In addition, the second dust collecting plate 145 is connected to a positive current and is positively conducted to push out positively-charged fine dust to the outside and collect the negatively-charged fine dust.

The base 141 may be made of an insulator to insulate the electric charge applied to the first dust collecting plate 143 and the second dust collecting plate 145 for preventing the movements thereof. In addition, the base 141 may be made of a light-transmissive transparent material (e.g., a glass substrate).

The first dust collecting plate 143 and the second dust collecting plate 145 may each include a conductor made of a light-transmissive transparent material. For example, the first dust collecting plate 143 and the second dust collecting plate 145 may each be made of transparent indium tin oxide (ITO).

The window-type dust collecting apparatus 1001 may transmit the light to increase illuminance of an inner space and obtain user's visibility to provide openness. In addition, excessive dust may be collected on each of the first dust collecting plate 143 and the second dust collecting plate 145, thereby deteriorating a dust collecting performance of the dust collector 101, but the dust collector 101 made of the transparent material may easily check an amount of collected dust for the user to easily determine a cleaning time.

The dust collector 101 includes a plurality of dust collecting structures 140 and the plurality of dust collecting structures 140 are disposed at constant distances. The plurality of dust collecting structures 140 may extend in the same direction and may be vertically tilted as shown in FIG. 15.

Although not clearly shown in the drawing, the sensor 400 may include a rain sensor to measure an amount of rain. In this case, the controller 200 may adjust an angle of the dust collecting structure 140 based on the amount of rain falling outside.

For example, the angle of the dust collecting structure 140 may be adjusted based on the angle of rain and the amount of rain falling outside to automatically clean and remove the dust collected by the dust collecting structure 140.

In addition, the controller 200 instantaneously applies positive current to the first dust collecting plate 110, applies negative current to the second dust collecting plate 120, and then turns off the power thereof. The controller 200 may control the dust collector 100 to self-clean by pushing and dropping the fine dust adsorbed on the dust collector 100.

In addition, the controller 200 may adjust an angle of the dust collecting structure 140 according to the user's command to adjust an amount of light entering the indoor space on sunny day and prevent rainwater from entering the indoor space on rainy day.

Figure 16:
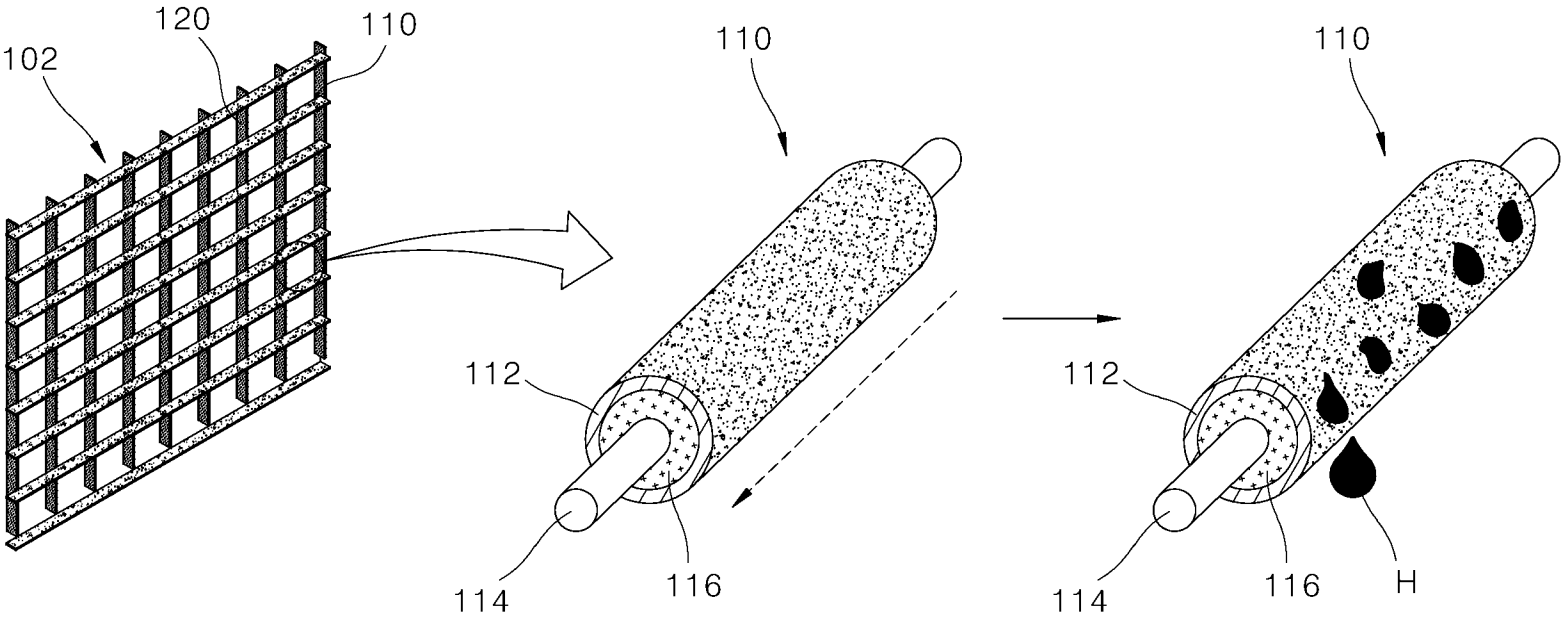
FIGS. 16 and 17 show a window-type dust collecting apparatus according to another embodiment of the present disclosure.
Figure 17:
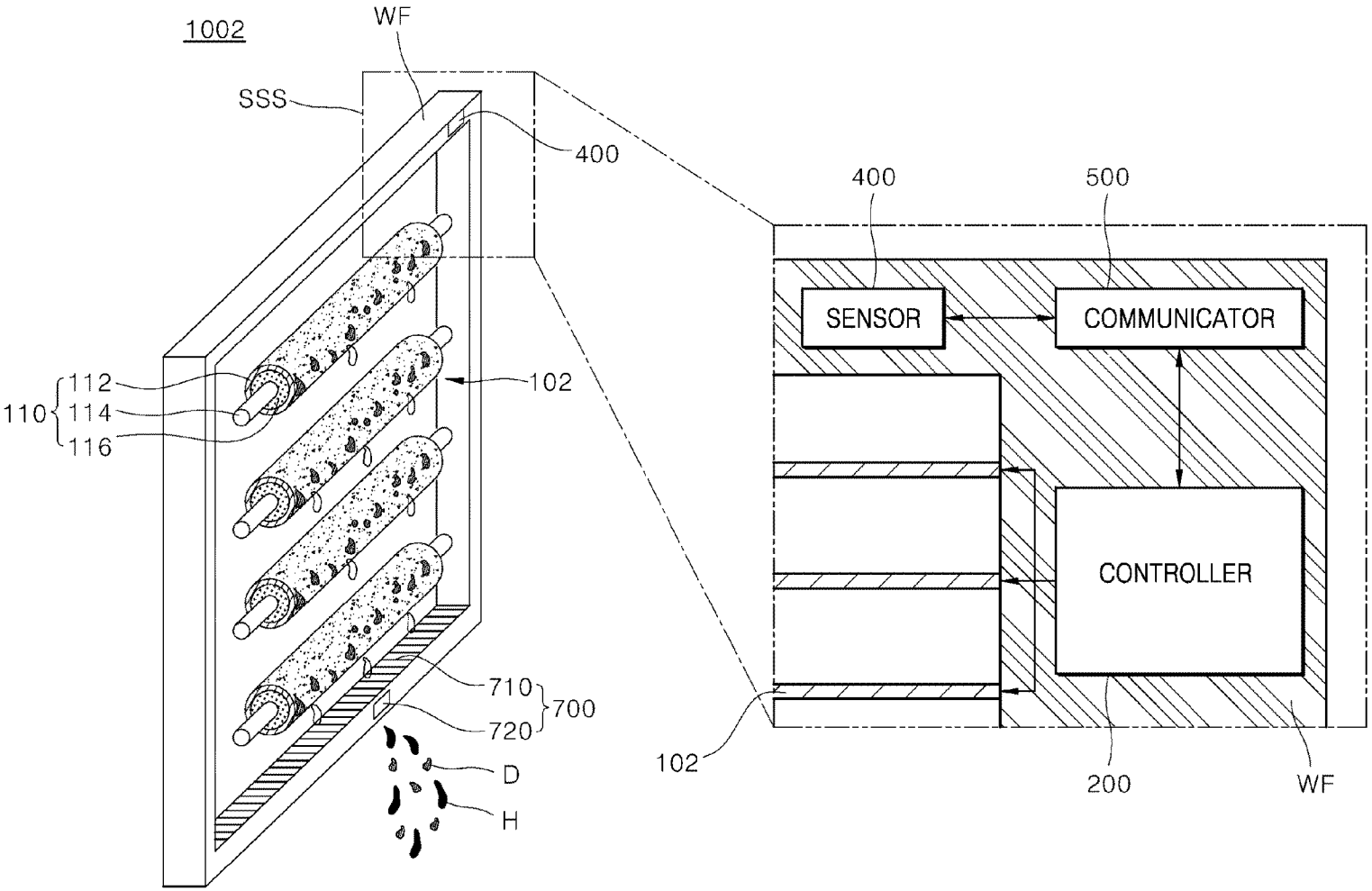

FIGS. 16 and 17 show a window-type dust collecting apparatus according to another embodiment of the present disclosure. Hereinafter, contents overlapping with the contents of the window-type dust collecting apparatus described above are omitted, and differences are described.

Referring to FIGS. 16 and 17, a dust collector 102 of a window-type dust collecting apparatus 1002 according to another embodiment of the present disclosure includes a first dust collecting plate 110 or a second dust collecting plate 120. The first dust collecting plate 110 or the second dust collecting plate 120 includes a cooling flow path.

Hereinafter, the first dust collecting plate 110 and the second dust collecting plate 120 are described in detail.

The first dust collecting plate 110 provides a flow path through which a refrigerant 116 flows and includes a conductor 112 having a surface to receive power and a heating wire 114 disposed inside the conductor 112.

Although not clearly shown in the drawings, the second dust collecting plate 120 has substantially the same structure as the first dust collecting plate 110. A temperature of the refrigerant 116 flowing in each of the first dust collecting plate 110 and the second dust collecting plate 120 is controlled by a cooler (not shown). The controller 200 controls the temperature of the refrigerant to form dew on each of the first dust collecting plate 110 and the second dust collecting plate 120.

The controller 200 controls the temperature of the refrigerant 116 to lower the temperature of the surface of each of the first dust collecting plate 110 and the second dust collecting plate 120 than a current dew-point temperature of air. The dew-point temperature refers to the atmosphere temperature when condensation occurs while the air is cooled and saturated without increasing or decreasing moisture at constant atmospheric pressure.

In this case, the sensor 400 includes a dew point sensor to detect a dew-point temperature. The dew point sensor may detect the dew-point temperature based on indoor temperature information and indoor humidity information.

The dew-point temperature detected by the dew point sensor is transmitted to the controller 200.

The controller 200 lowers the temperature of the refrigerant 116 to lower a temperature of a surface of each of the first dust collecting plate 110 and the second dust collecting plate 120 than the detected dew-point temperature. As a result, moisture (H) in the air is condensed on each of the first dust collecting plate 110 and the second dust collecting plate 120 to increase a collecting power of the fine dust, and the collected fine dust (D) falls downward with the condensed moisture (H).

Additionally, the moisture (H) that has fallen downward is introduced into a water collecting unit 700 together with the fine dust (D). The water collecting unit 700 may be disposed at a lower portion of the dust collecting frame WF and includes a water channel 710 to collect moisture (H) that has fallen downward and a drain nozzle 720 to discharge water collected in the water channel 710.

The controller 200 discharges the water by opening the drain nozzle 720 when the water is collected in the water channel 710 above a certain level.

The controller 200 determines whether to open the drain nozzle 720 based on the amount of rain falling outside. In this case, the controller 200 may use the data received from the rain sensor of the sensor 400 to measure the amount of rain.

As the first dust collecting plate 110 and the second dust collecting plate 120 are each self-cleaned by the condensed moisture, the cleaning time of the window-type dust collecting apparatus 1002 may be increased. Therefore, the maintenance cost of the window-type dust collecting apparatus 1000 and user's time consumption for cleaning is reduced, thereby improving user convenience.

In addition, as the humidity of the air introduced into the indoor space is adjusted based on the condensed moisture of the air introduced into the dust collector 102, the window-type dust collecting apparatus 1002 may operate as a dehumidifier. The user may adjust the indoor humidity using the window-type dust collecting apparatus 1002 without a dehumidifier, thereby improving the operating efficiency of the window-type dust collecting apparatus 1000 and improving user convenience.

It should be understood that the above-described embodiments are illustrative in all respects and not limiting, and the scope of the present disclosure will be indicated by the following claims rather than the above description. The meaning and the scope of the following claims, as well as all changes and modifications derived from the equivalent concept should be construed as being included in the scope of the present disclosure.

The invention claimed is:

1. A window-type dust collecting apparatus, comprising:

a power supply configured to provide a positive current and a negative current;

a dust collector comprising a first dust collecting plate configured to being negatively charged based on the negative current and a second dust collecting plate spaced apart from the first dust collecting plate and configured to being positively charged based on the positive current;

a first sensor configured to detect a wind speed;

a second sensor configured to detect a concentration of dust;

a controller configured to adjust an intensity of power applied to each of the first dust collecting plate and the second dust collecting plate based on the wind speed detected by the first sensor or the dust concentration detected by the second sensor; and a dew point sensor configured to detect a dew-point temperature, and wherein the controller is configured to control a surface temperature of the first dust collecting plate or the second dust collecting plate to be less than the dew-point temperature detected by the dew point sensor, wherein the first dust collecting plate or the second dust collecting plate comprises:

a conductor defining a flow path through which a refrigerant flows and having a surface to receive the positive current or the negative current; and a heating wire disposed inside the conductor, wherein the controller is configured to control a cooler to lower a temperature of the refrigerant for lowering the temperature of the surface than the dew-point temperature.

2. The window-type dust collecting apparatus of claim 1, wherein the first dust collecting plate comprises a plurality of first sub-dust collecting plates arranged in parallel in a first direction, wherein the second dust collecting plate comprises a plurality of second-sub dust collecting plates arranged in parallel in a second direction, and wherein the second direction crosses the first direction.

3. The window-type dust collecting apparatus of claim 1, wherein, based on an increase in the wind speed or in the concentration of the dust, the controller is configured to increase the intensity of the power applied to each of the first dust collecting plate and the second dust collecting plate to increase an intensity of a magnetic field generated in each of the first dust collecting plate and the second dust collecting plate.

4. The window-type dust collecting apparatus of claim 1, wherein the dust collector comprises a plurality of dust collecting structures in which the first dust collecting plate is disposed on a first surface thereof and the second dust collecting plate is disposed on a second surface thereof, and wherein the plurality of dust collecting structures are spaced apart from one another at equal distances and are arranged in parallel.

5. The window-type dust collecting apparatus of claim 4, wherein the first dust collecting plate or the second dust collecting plate is made of a transparent conductor.

6. The window-type dust collecting apparatus of claim 1, comprising:

a window frame, a first window and a second window respectively slidably disposed inside the window frame and configured to open and close the window frame, a dust collecting frame disposed outside each of the first window and the second window and configured to couple the dust collector to the window frame, and a switch disposed at one side of the dust collecting frame and configured to detect an open state of the window frame.

7. The window-type dust collecting apparatus of claim 6, wherein the switch comprises a first electrode disposed at one side of the dust collecting frame and a second electrode disposed at one side of the second window, and wherein the controller is configured to apply the power to the dust collector when the first electrode contacts the second electrode.

* * * * *